United States Patent [19]

Knudsen

[11] 4,005,971

[45] Feb. 1, 1977

[54] CASTING MACHINE FOR MAKING CONCRETE SLABS

[75] Inventor: Niels Hjarno Knudsen, Dragor, Denmark

[73] Assignee: N. Hjarno Knudsen A/S, Kastrup, Denmark

[22] Filed: Feb. 5, 1975

[21] Appl. No.: 547,246

Related U.S. Application Data

[63] Continuation-in-part of Ser. No. 377,194, July 9, 1973, abandoned.

[30] Foreign Application Priority Data

July 8, 1972 Germany ..... 7225536[U]

[52] U.S. Cl. ..... 425/410; 425/456

[51] Int. Cl.[2] ..... B28B 3/02

[58] Field of Search ..... 425/421, 457, 456, 410

[56] References Cited

UNITED STATES PATENTS

| | | | |
|---|---|---|---|
| 1,123,358 | 1/1915 | Palmer | 425/456 X |
| 2,541,981 | 2/1951 | Babcock | 425/432 X |
| 3,149,392 | 9/1964 | Ripley | 425/439 X |

FOREIGN PATENTS OR APPLICATIONS

| | | | |
|---|---|---|---|
| 1,107,142 | 5/1961 | Germany | 425/456 |

*Primary Examiner*—Robert D. Baldwin
*Attorney, Agent, or Firm*—Cushman, Darby & Cushman

[57] ABSTRACT

A casting machine for making concrete slabs having a mold swingable about a horizontal axis and a vibrator swingable in a horizontal plane adjustable in height about a vertical axis from an inactive position at the side of the machine and into a working position above the mold. The vibrator is provided with a pressure plate for vibrating, compacting and glazing the surface of the concrete inside the mold, the bottom of which can be adjusted in vertical direction for producing slabs having different thicknesses. Further, the bottom is slidable from a filling position to a stripping position when the mold is turned 180° about a horizontal axis.

6 Claims, 3 Drawing Figures

CASTING MACHINE FOR MAKING CONCRETE SLABS

Figure 1:
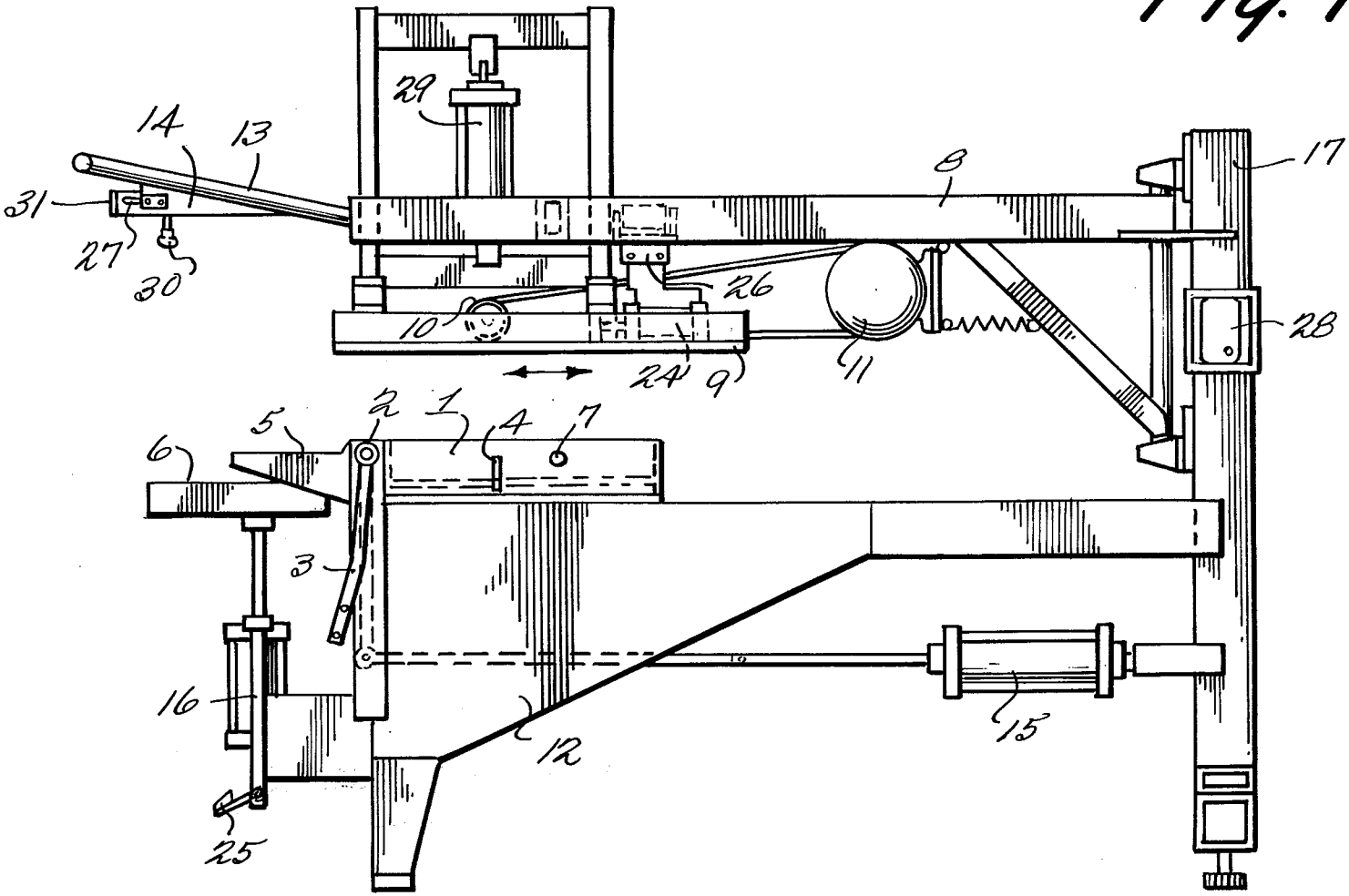

This application is a continuation-in-part of Ser. No. 377,194 filed July 9, 1973 (now abandoned).

The invention relates to a casting machine for making concrete slabs and having an interchangeable mold swingable about a horizontal axis in such a manner that upon filling of the mold with concrete and compacting of the concrete by a displaceable vibrator the mold may be turned upside down, so that the cast slab may slide out of the mold and be removed on a take-off plate.

The vibrator which should not be located above the mold during its filling and turning, and must be easily slidable into its working position over the mold. It has been proposed to arrange it together with the motor producing the vibrator table movable on rails at the upper side of a frame which is also supporting the mold during casting. The movable vibrator table is provided with a handle by means of which the user of the machine standing at the opposite side of the mold must draw the vibrator table towards himself until the vibration means are located above the concrete in the mold, and after the use of the vibrator he must again push it back into its inactive position. This procedure is rather awkward and tiresome for the worker.

U.S. Pat. No. 2,541,981 discloses a concrete block packing machine having a packing head, which on a horizontal arm can be swung over a mold box and be made to function as a pressure and vibration plate, as the head preferably substantially comforms to the inner dimensions of the mold box. When the block is compacted or packed to a desired firmness, it is removed by lateral movement.

U.S. Pat. No. 3,149,392 discloses a block molding machine of another type, in which vibration is carried out from the underside of the mold. The mold is built up by a mold frame in which the real mold is inserted. In this known machine a mold stripping apparatus comprising an invertor and a vertically movable receiving table is used.

In contrast to the machines known from the two U.S. patents mentioned above, which are intended for the manufacture of blocks, it is an object of the present invention to provide a lighter and simpler molding machine of the above mentioned kind for the manufacture of slabs provided with a vibrator which is easier to operate than the aforementioned vibrator which is movable on rails and being characterized in that it is not only works as a pressure and vibration plate, but also as a glazing plate, which can make small reciprocating oscillations in its own plane, and, if desired, in two directions perpendicular to each other.

Another object of the present invention is to provide a slab molding machine using the combined pressure, vibration and glazing effect in the production of slabs having many different forms and thicknesses.

Still another object of the invention is the provision of a machine with a mold frame having interchangeable bottom plates for the production of slabs having differently formed surfaces, for example grooved or ornamented surfaces.

Figure 2:
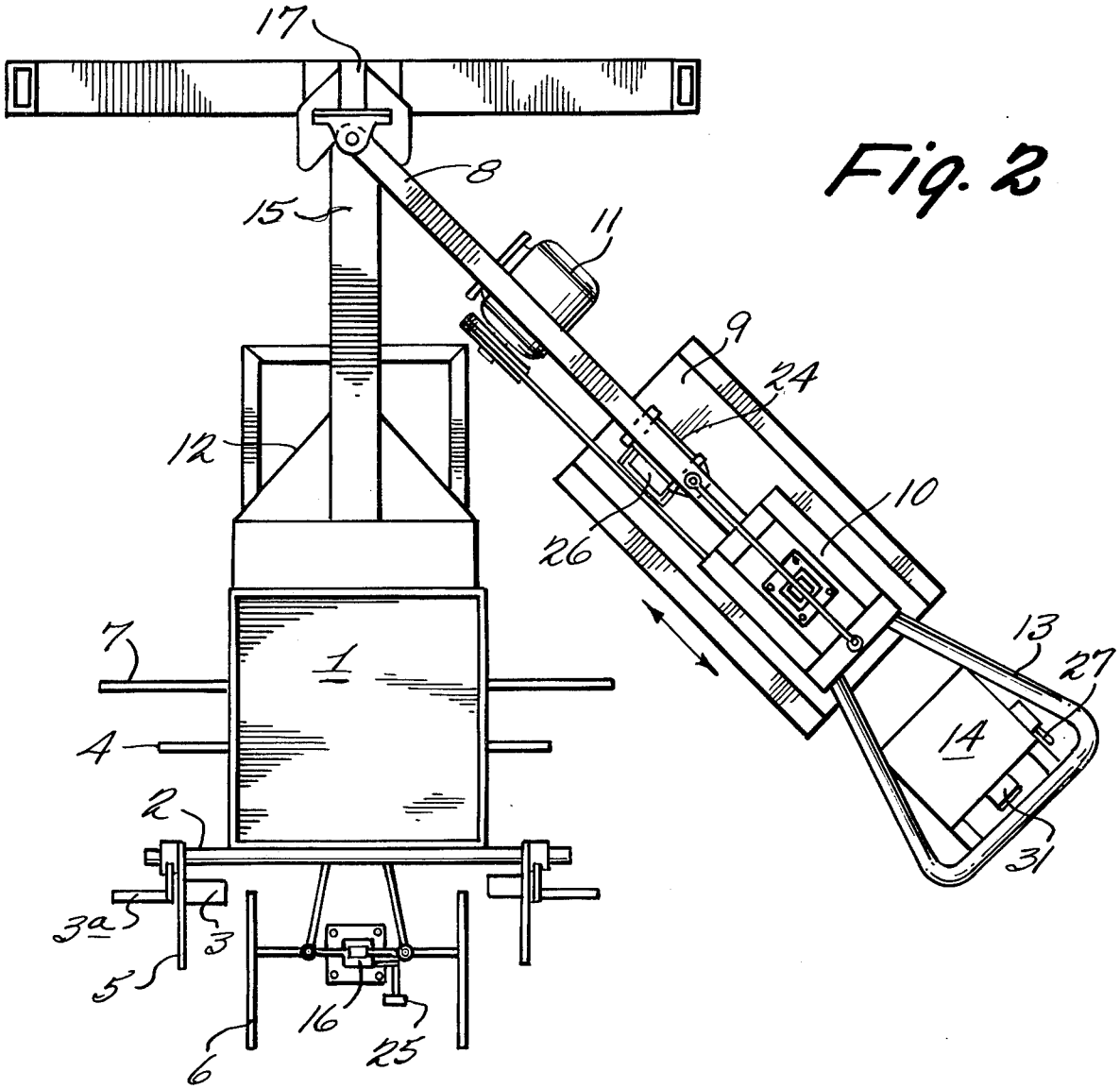
Figure 3:
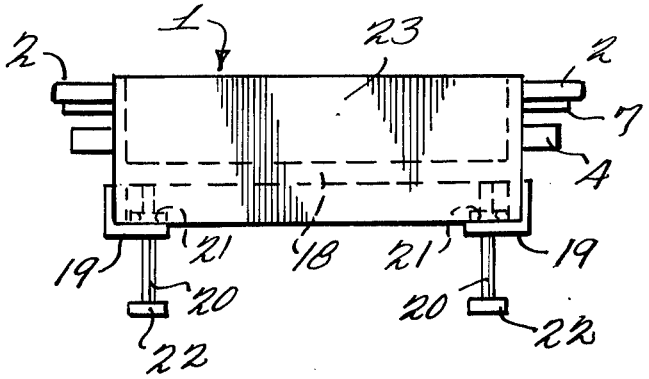

Other objects and advantages will appear from the following description in connection with the drawings, in which FIG. 1 is a side elevational view of an embodiment according to the invention, FIG. 2 a plan view of the machine of FIG. 1 on a smaller scale, in which the vibrator is in its swung position, FIG. 3 a mold with an adjustable bottom plate to be used in the casting machine of FIGS. 1 and 2.

The machine shown in the drawings has a mold 1, which by means of a shaft 2 is pivotally mounted in a mold suspension 5, so that it can be swung into a position above a receiving table 6. A pair of plate holders 3 are further pivotally mounted upon the shaft 2 and carry handles, so that they can be swung in over a take-off plate (not shown) placed upon the mold, whereby the cast slab, the mold and the take-off plate are kept together during swinging when the worker grasps the handles of the plate holders 3 and at the same time handles 7 extending from the mold. When the mold hereby is turned 180° about the shaft 2, the take-off plate is resting on the receiving table 6, and when the handles of the plate holders are released, the take-off plate, the slab and the receiving table 6 will slide downwardly until the slab has left the mold which is held in position because abutments 4 on the mold are abutting horns extending from the mold suspension 5. The receiving table 6 can be balanced by a counterweight, or it may be moved by a hydraulic or pneumatic lifting and lowering device 16 controlled by a pedal 25.

At the end of the machine frame 12 turning away from the mold 1 is arranged a column 17 upon which a swingable arm 8 is pivotally mounted, so that from the swung-out position shown in FIG. 2 it can be swung in over the mold to the position shown in FIG. 1 in which the pressure plate 9 can be pressed down towards the concrete in the mold and can be put into a vibrating movement by vibration means formed as a shaft carrying an eccentric 10 driven from an electromotor 11 supported by the vibrator. The plate 9 has three functions viz. pressing, vibrating and glazing. The length of the said plate is longer than that of the mold, whereas the width of the plate normally is somewhat smaller than that of the mold, in which case the plate by swinging the arm 8 is moved over the mold in such a manner that the complete surface of the poured material is worked.

First, the material is compacted by the pressure plate 9 slowly being swung over the mold simultaneously with its being lifted, lowered and vibrated, whereafter the vibrations are stopped, and the plate 9 is used in a glazing movement levelling the surface of the material with the mold edges as the plate, by means of the arm 8, is laterally moved in short, reciprocal movements over the concrete surface for glazing the said surface in such a manner that the plate will easily slip the material during the following stripping. If desired, the plate 9 can also be adapted to make short, reciprocating glazing movements in the longitudinal direction of the swingable arm 8, as a double working pneumatic or hydraulic cylinder (24) may be mounted on the pressure plate, by means of which cylinder the plate can be moved in forward and backward directions in this radial direction simultaneously with the swingable arm moving the plate reciprocally in the vertical direction. The piston in the cylinder 24 is controlled by changeover valves 26, which are activated by an operating valve 27.

The mold 1 consists of a frame 23, in which a mold bottom 18 is mounted, bottom 18 being indicated by dotted lines in FIGS. 1 and 3 and being adjustable in height by means of adjusting means 19–22 adapted to permit the bottom plate, when turning the mold, to slide down to the lowest edge of the mold frame, but to prevent bottom plate 18 from falling out of the frame. Since the mold frame is interchangeable and the height of the mold bottom 18 is adjustable, slabs of many different shapes and thicknesses can be produced by the machine according to the invention. As compacting by means of the pressure plate 9, contrary to a normal procedure, takes place from the under side of the finished slab, its surface can be provided with different ornamentations or patterns by a corresponding design in the interchangeable bottom plate, which determines the design of the surface of the slab. In the embodiment shown in the drawings the bottom adjusting means comprise brackets 19 having holes for screw-cut spindles 20 secured to the bottom plate with a nut 21 to adjust the bottom in height, and a head 22 stopping the bottom plate 18 flush with the edges of the side wall when the mold is turned 180° for stripping.

According to the invention the swingable arm 8 is preferably slidingly mounted in the elevational direction on the column 17 in such a way that the working height of the pressure plate 9 is adjustable and the plate can be used in connection with mold frames 1 of different heights. This embodiment is shown in FIG. 1, in which 28 indicates a lifting cylinder for changing the mounting height of the swingable arm 8 on the column 17.

At its free end the swingable arm 8 is provided with a handle 13 by means of which it may be swung into and out of working position, said handle carrying a control board 14 with a switch 30 for controlling lowering and lifting of the pressure plate 9, preferably pneumatically or hydraulically by a press cylinder 29 and a switch 31 for starting and stopping the vibrator motor 11. In the embodiment shown the control board 14 is further provided with a control member for controlling an auxiliary device comprising a lifting cylinder 15, one end of which is hingedly connected to an arm rigidly secured to the mold 1 in such a manner that said device can co-operate in lifting and turning the mold.

It will be understood that the inventive machine can be used without any strong manual effort and without using big movements of the arms, as the vibrator should only be swung from the side of the machine and inwards above the mold and the various control members be activated in a correct sequence in order that compacting of the concrete and vibrating and turning of the mold as well as removal of the slab can take place. If desired, the swingable arm 8 can also be adapted to be mechanically moved by means of a double working pneumatic cylinder piston mechanism, which can be mounted on the machine as an auxiliary fitting.

I claim:

1. In a casting machine for making concrete slabs and having a concrete receiving interchangeable mold comprising side walls and a bottom, and being mounted in support so as to be swingable 180° about a horizontal axis from a concrete filling position into a mold stripping position, and a vibrator displaceably mounted above the mold, the improvement comprising means for mounting the vibrator swingable about a vertical axis from a position at the side of the mold to a working position over the mold in its filling position, and a vertically movable pressure and vibrator plate mounted on said vibrator so that it can be brought to press against and vibrate the surface concrete filled into and up over the top edge of the mold walls in a sidewardly reciprocating movement, means for activating and deactivating the vibrator and means for reciprocating said plate relative to said arm to perform short glazing reciprocations in its own horizontal plane without vibrations.

2. In a casting machine according to claim 1 having a frame for supporting the mold in a casting position and mounting means allowing turning of the mold above a receiving table at one end of the frame, the further improvement wherein the vibrator and pressure plate is carried by an arm mounted swingable about a vertical axis at the end of the frame opposite the mold, said arm being adjustable in vertical direction along its pivot axis and having a handle for carrying control members for lowering said pressure plate and for starting and stopping the vibrator.

3. In a casting machine according to claim 2 and having an auxiliary means for lifting and turning the mold the further improvement wherein said handle for swinging the vibrator further includes a control member for activating said auxiliary device.

4. In a casting machine according to claim 2 the further improvement wherein a double-acting cylinder means is provided for swinging the arm from the position at the side of the mold into the working position and vice versa.

5. In a casting machine according to claim 1 the further improvement wherein said mold has a vertically adjustable bottom and means for guiding said bottom from its vertically adjusted position to a position flushing with the upper edges of the side walls when the mold is turned 180° from filling position to mold stripping position.

6. In a casting machine according to claim 1 the further improvement wherein said reciprocating means includes a double-acting cylinder means for moving the pressure plate in reciprocating glazing movements in its own plane and radially relative to the vertical pivot axis of the vibrator.

* * * * *